United States Patent [19]

Mitcham et al.

[11] Patent Number: 4,934,243

[45] Date of Patent: Jun. 19, 1990

[54] ELECTROMAGENTIC PROJECTILE LAUNCHER

[75] Inventors: Alan J. Mitcham, Newcastle-upon-Tyne; Derek Putley, Wantage, both of England

[73] Assignee: The Secretary of State for Defence in Her Britannic Majesty's Government of the United Kingdom of Great Britain and Northern Ireland, London, United Kingdom

[21] Appl. No.: 339,620

[22] PCT Filed: Oct. 1, 1987

[86] PCT No.: PCT/GB87/00695

§ 371 Date: May 31, 1989

§ 102(e) Date: May 31, 1989

[87] PCT Pub. No.: WO88/02467

PCT Pub. Date: Apr. 7, 1988

[30] Foreign Application Priority Data

Oct. 3, 1986 [GB] United Kingdom ..... 8623767

[51] Int. Cl.[5] ..... F41B 6/00

[52] U.S. Cl. ..... 89/8; 124/3

[58] Field of Search ..... 89/8; 124/3; 310/12; 318/135

[56] References Cited

U.S. PATENT DOCUMENTS

H000,357 11/1987 Howland et al. ..... 89/8

4,369,692 1/1983 Kemeny ..... 89/8

*Primary Examiner*—Stephen C. Bentley

*Attorney, Agent, or Firm*—Cushman, Darby & Cushman

[57] ABSTRACT

An electromagnetic projectile launcher (commonly referred to as a "railgun") consists of an electrical direct current power supply, two parallel rails (52), and switching armature (54) releasably linked to a projectile armature (56), each armature being slideably located in mutually parallel channels between and along the length of the rails. The rails are each provided with two overlapping conductive zones along their length, the first zone (60) being electrically connected to the power source and in electrical contact with the switching armature in its start position. In operation, electromagnetic forces induced by the power supply propel the switching armature (54), and hence the projectile armature (56) linked to it, along the rails from the start position until the projectile armature comes into electrical contact with the second conductive zone (62). Thereafter the switching armature travels to a position where it is eliminated from the power supply curcuit to prevent it remaining a resistive element in the circuit, the link between the two armatures is broken, and the projectile armature (56) is accelerated through the second zone (62) to its launch velocity to launch the projectile (72). The overlap of the conductive zones (60,62) reduces the tendency for arcing to occur at the trailing edge of the switching armature (54) as it is eliminated from the circuit.

7 Claims, 3 Drawing Sheets

ELECTROMAGENTIC PROJECTILE LAUNCHER

The invention relates to an electromagnetic projectile launcher.

Electromagnetic projectile launchers (usually referred to as "railguns") utilise high direct current (DC) to launch projectiles. The basic construction of a railgun (see FIG. 1) comprises a power supply circuit having two generally parallel rails bridged by a projectile armature. In operation the rails are short-circuited until the current level required for launch is achieved whereupon the current is allowed to flow through the projectile armature. The projectile armature is accelerated to launch speed owing to the inter-action of the current in the projectile armature with the magnetic field induced between the rails.

The typical requirements for the switch short circuiting the rails during the current build up are: very low resistance (usually less than $10\mu\Omega$); high current bearing capability (usually of the order of 1 MA for periods of 200 ms); capacity for repeated operation; and capacity for current transfer without damage to itself.

In several practical embodiments of such a short-circuiting switch, the switch itself is a subsidiary railgun and is usually referred to as a "railswitch". The railswitch has its own set of rails and has an armature which is tethered during the current build up. Once released, the switch armature is driven, similarly to the projectile armature, to a final position, in which position the current has been switched to flow through the projectile armature.

In one form of railswitch, the switch armature (see FIG. 2, for example) commutates the current across a gap in one of the rails and, in its final, arrested position, remains as a resistive element in the circuit thereby affecting the performance of the railgun.

Other forms of railswitches have been proposed in which the switch armature is eliminated from the circuit in the arrested position thereof. However, in those proposals the projectile armature is itself in the circuit, and thus subject to ohmic heating and electro-motive forces, during the current build up.

All of these forms of railswitch suffer from arcing at the trailing edge of the switch armature causing damage to the switch armature and the rails therefor. This problem arises because a reactance voltage, driven by the elemental inductance of the circuit, is generated during commutation of the current. Although solutions have been proposed to this problem (for example see U.S. Pat. No. 4369692), none have been entirely successful.

It is an object of the present invention to provide an electromagnetic projectile launcher in which at least some of the aforementioned disadvantages are reduced or obviated.

According to the invention, an electromagnetic projectile launcher comprises an electrical power source for supplying direct current, a pair of substantially parallel rails, a first armature and a second, projectile armature. The armatures are located between the rails for movement relative thereto. Each rail has first and second conductive zones which overlap one another in the longitudinal direction of the rails. The first zone of each rail is electrically connected to the source. The first armature is, in a start position, in electrical contact with the first zones and is propellable by electromagnetic forces along the rails thereby to disengage from the first zones. The second armature is propellable by the first armature into electrical contact with the second zones thereby to be propellable by electromagnetic forces along the rails independently of the first armature. The overlap of the first and the second zones extend in the longitudinal direction such that the second armature at least partially contacts said second zones before the first armature completely disengages from said first zones. The edges of the first zones from which the first armature disengages are tapered in a sense to cause current in the first armature to concentrate in the first armature as close to the second armature as possible.

Preferably, the first armature is releasably restrainable in said start position.

Preferably, said overlap of said zones has an extent in said longitudinal direction such that the second armature completely contacts said second zones before the first armature completely disengages from said first zones.

Preferably, arc resistant electrodes are mounted on the edges of said first zones from which the first armature disengages. In addition, or alternatively, arc resistant electrodes are mounted on the trailing end of the first armature.

Electromagnetic projectile launchers will now be described to illustrate the invention by way of example only with reference to the accompanying drawings, in which.

Figure 3:
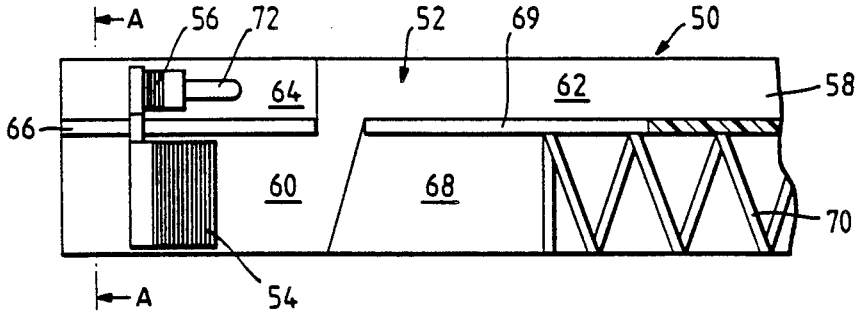
FIG. 3 is a schematic longitudinal section through the rail system of a first embodiment of an electromagnetic projectile launcher constructed in accordance with the present invention, the armatures being in a start position.
Figure 4:
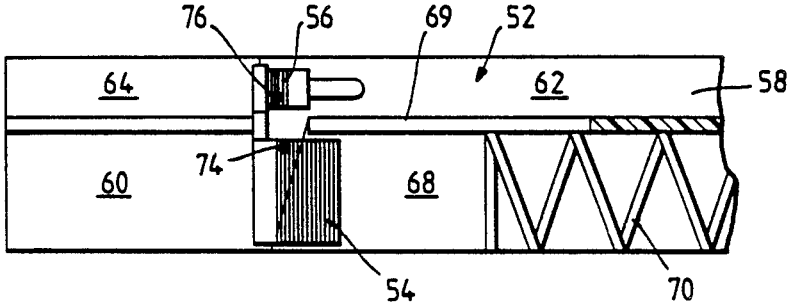
FIG. 4 is a section as shown in FIG. 3 but with the armatures shown in an intermediate position.
Figure 5:
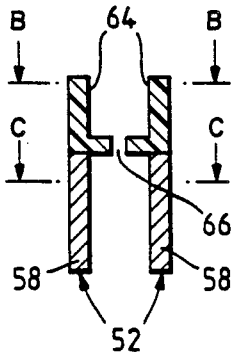
FIG. 5 is a schematic section on line A—A in FIG. 3.
Figure 6:
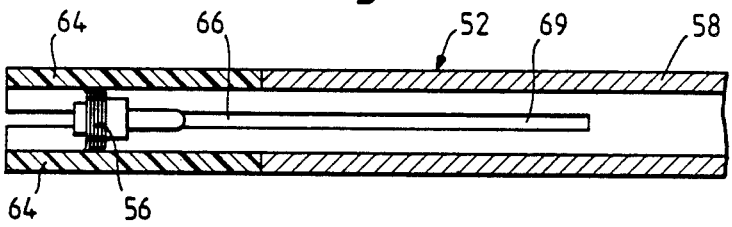
Figure 7:
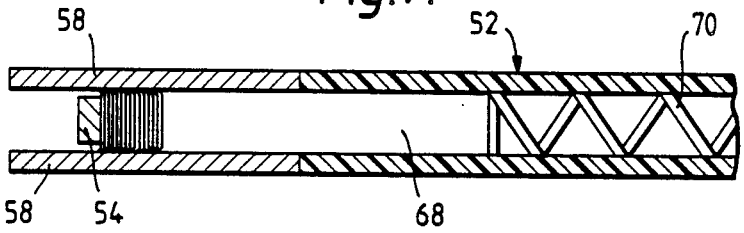
Figure 8:
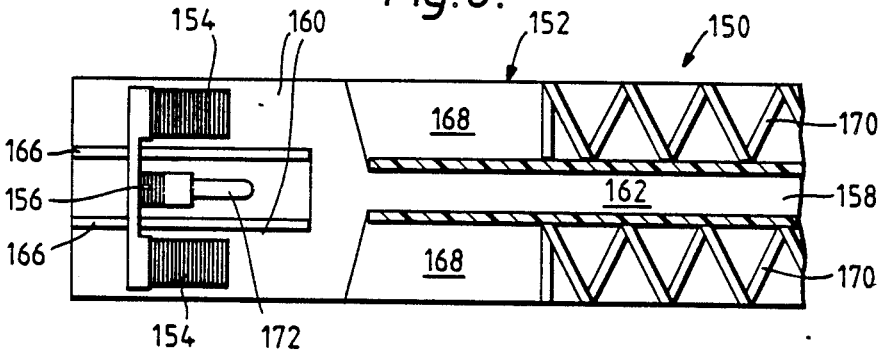
Figure 9:
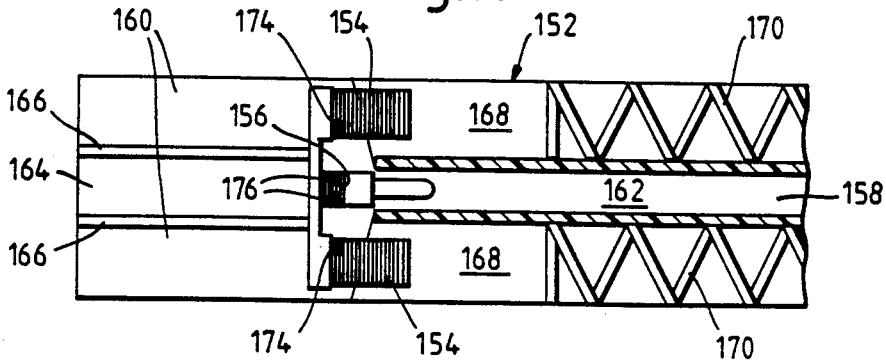

FIGS. 6 and 7 are schematic sectional views on lines B—B and C—C, respectively, in FIG. 4; and FIGS. 8 and 9 are views similar to FIG. 3 and 4, respectively, of a second embodiment of an electromagnetic projectile launcher constructed in accordance with the present invention.

Figure 1:
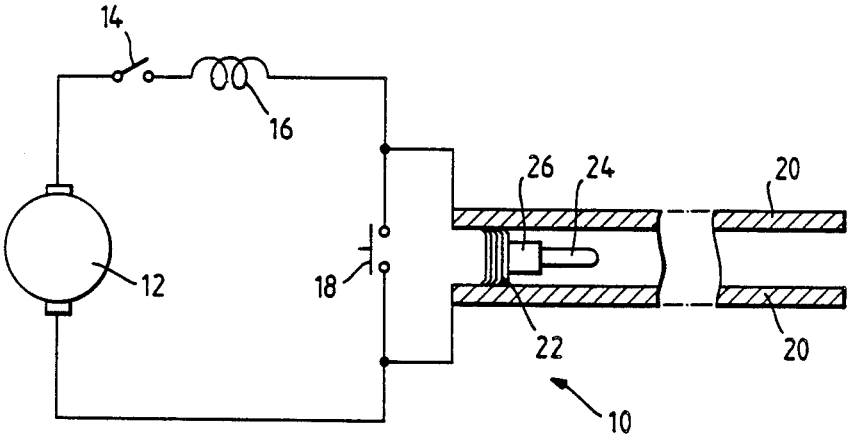
FIG. 1 is a schematic circuit diagram showing the basic principle of an electromagnetic projectile launcher.

Referring to FIG. 1, a typical electromagnetic projectile launcher, i.e. "railgun", is shown generally at 10. The railgun 10 has an electrical power supply consisting of a homopolar direct current (DC) generator 12; a closing switch 14; a storage inductor 16 (which may be integral with the generator); and a short-circuiting switch 18. Two parallel conducting rails 20 are connected to the supply across the shorting switch 18. A projectile armature 22 is located between the rails 20 and is designed to propel a projectile 24. In general, the projectile armature 22 may be of metal or other conducting material, insulated at 26 from the projectile 24, or of plasma.

In operation, the switch 14 is closed to charge the inductor 16 and, once the required current level has been achieved, the short-circuiting switch 18 is opened to divert the current through the projectile armature 22. The armature 22 is then propelled by electromagnetic forces along the rails 20 to launch the projectile 24.

Figure 2:
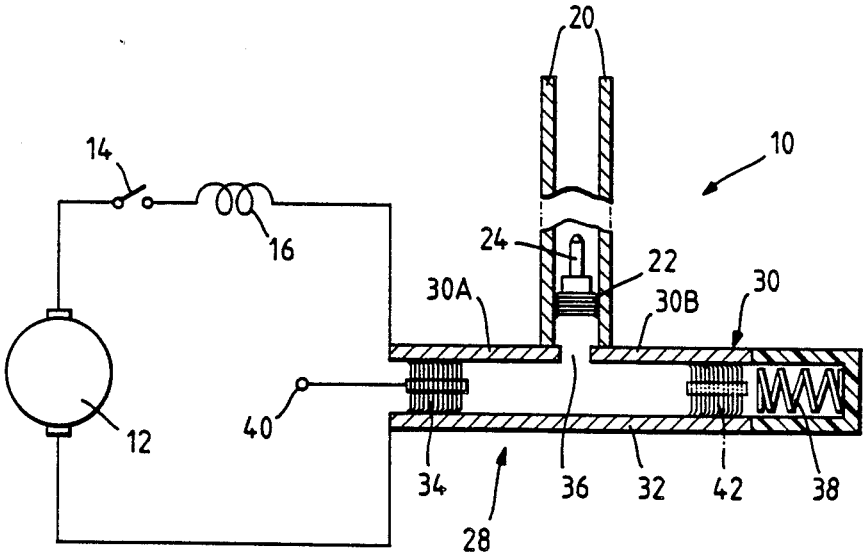
FIG. 2 is a diagram similar to FIG. 1 of a known type of launcher.

Referring to FIG. 2, the rails 20 of the railgun 10 are connected to the supply by a railswitch 28. The railswitch 29 has two parallel conducting rails 30, 32 connected in the generator circuit and a switching armature 34. The rail 30 has two sections 30A and 30B which are separated from one another by a gap 36 at a position remote from the supply, the rails 20 for the projectile being connected to the sections 30A and 30B of the rail 30, one on each side of the gap 36. Energy absorbing means 38 (which can be hydraulic, mechanical or electromagnetic) is located at the ends of the rails 30, 32 to stop the switching armature 34 once the current has been switched into the rails 20.

In operation, the switching armature 34 is initially restrained against movement along the rails 30, 32 being releasably restrained at 40. Once the required current level is achieved, the switching armature 34 is released and is propelled along the rails 30, 32 to its final position which is indicated in ghost outline at 42. As the switching armature crosses the gap 36 in the rail 30, the current is commutated from section 30A to section 30B thereby to bring the rails 20 and the projectile armature 22 into circuit. The projectile armature is then propelled along the rails 20 to launch the projectile 24.

As discussed previously, these and similar railgun systems suffer from a number of disadvantages.

The invention will now be described with reference to FIGS. 3 to 9.

In the first embodiment (see FIGS. 3 to 7), an electromagnetic projectile launcher or railgun 50 constructed in accordance with the invention has any suitable electrical power supply (not shown) and it can be similar to the supply shown in FIGS. 1 and 2.

The railgun 50 has two parallel rails 52 between which are located two armatures 54, 56 for movement relative thereto.

Each rail 52 has a single conductor 58 shaped to form first and second conductive zones 60, 62 which overlap one another in the longitudinal direction of the rails 52. The conductor 58 is electrically connected to the supply at the free end of the zone 60.

Mounted on each conductor 58 adjacent the respective first zone 60 is an L-shaped insulating member 64, the two members 64 together forming a U-shaped channel which guides the projectile armature 56 prior to the armature 56 engaging the second zones 62 of the rails 52. The channel formed by the members 64 is slotted along its base as indicated by the reference numeral 66.

An insulated chamber 68 forms a guide for the first armature 54 once the armature 54 has disengaged from the first zones 60 of the rails 52. Energy absorbing means 70 of any suitable type is located in the chamber 68 to stop the armature 54 once it has disengaged from the first zones 60.

The armatures 54, 56 typically consist of metal leaves held together whereby the angled ends of the leaves resiliently press against the rails 52.

In the start position, the first armature 54 is mechanically coupled to the projectile armature 56 whereby the armature 54 can propel the armature 56 into contact with the second conductive zones 62 of the rails 52. The mechanical coupling of the armatures 54, 56 can take any suitable form and may, for example, consist of a tab extending from the armature 54 to engage the rear of the armature 56, the chamber 68 being slotted at 69. Alternatively, a shearable pin arrangement may connect the two armatures 54, 56.

In operation, the coupled armatures 54, 56 are loaded into their initial positions (see FIG. 3) between the rails 52. In these positions, the first armature 54 is in sliding electrical contact with the first zones 60 and the second armature 56 is in sliding engagement with the insulating members 64 to be guided thereby.

The first armature 54 is releasably restrained from movement and the supply circuit closed to allow the current level to build up. Once the required current level is reached, the armature 54 is released and is accelerated by electromagnetic forces to a suitable speed to achieve switching of the current into the second armature 56, e.g. of the order of 32–40 m/s, before it disengages from the first zones 60 and enters into the chamber 68 to be brought to rest by the energy absorbing means 70.

Owing to the mechanical coupling between the armatures 54, 56, the projectile armature 56 is accelerated by the armature 54 and moves through the guide channel formed by the members 64 into engagement with the second zones 62. Following separation of the armatures 54, 56, the projectile armature 56 is then independently accelerated by electromagnetic forces up to launch speed and the projectile 72 is launched.

As can be seen the conductive zones 60, 62 of the rails 52 overlap to an extent such that the armature 56 has moved into engagement (preferably completely into engagement) with the second zones 62 before the armature 54 has disengaged from the first zones 60. Preferably, the exist edges of the first zones is angled to force current in the armature 54 to center (at 74) at a position relatively close to the center (at 76) of current in the armature 56 thereby to assist commutation of the current and to lower the reactance voltages and reduce arcing.

The commutation of the current can be further assisted by introducing into the process an element of resistive commutation. That is achieved by providing arc resistant electrodes (which have a higher resistance than the material of the conductors 58 and of the armature leaves) either on the exit edges of the first zones 60 or on the trailing edges of the armature 54 or on both. Such electrodes also reduce the liklihood of damage from any arcing which may occur upon separation of the armature 54 from the zones 60.

In the second embodiment (see FIGS. 8 and 9), the basic structure is very similar to that described with reference to FIGS. 3 and 7 and, accordingly, the same reference numerals as used in FIGS. 3 to 7 but with a prefix "1" have been used in FIGS. 8 and 9.

In the second embodiment, the conductors 158 of the rails 152 are Y-shaped whereby the first conductive zones 160 are each divided into two and extend on either side of the respective insulating member 164 which in this instance is generally U-shaped. Consequently, two first armatures 154, and corresponding chambers 168 and energy absorbing means 170, are provided, one for each limb of the split zone 160. The projectile armature 156 is mechanically coupled to both of the armatures 154 for propulsion along the rails 152.

The operation of the launcher 150 is substantially the same as the operation of the launcher 50.

In the launcher 150, the elemental inductance associated with the two current loops formed between the projectile armature 156 and the two first armatures 154 during commutation is less than the elemental induction associated with the single current loop formed in the launcher 50. Consequently, the reactance voltage of the commutation in the launcher 150 is further reduced and arcing is less likely to occur or persist.

Other advantages of launchers constructed in accordance with the present invention as compared to the known proposals are the complete elimination of the projectile armature from the circuit prior to the commutation of the current thereto and complete elimination of the first armature from the circuit following commutation of the current to the projectile armature. Conveniently, the projectile armature is already in motion before it is propelled along the rail structures by electromagnetic forces.

In a modification, the first armature can be located, in its start position, in a region of zero force. In that instance, the first armature would not be releasably restrained, but would be moved from the region of zero force, by an external actuator for example, following the current build phase.

We claim:

1. An electromagnetic projectile launcher comprising:

an electrical power source for supplying direct current, a pair of substantially parallel rails, and a first armature and a second, projectile armature, the armatures being locatable between the rails for movement relative thereto, each rail having first and second conductive zones which overlap one another in the longitudinal direction of the rails, said first zone of each rail being electrically connected to the source, the first armature being, in a start position, in electrical contact with said first zones and being propellable by electromagnetic forces along the rails thereby to disengage from said first zones, the second armature being propellable by the first armature into electrical contact with said second zones thereby to be propellable by electromagnetic forces along the rails independently of the first armature, said overlap of said zones having an extend in said longitudinal direction such that the second armature at least partially contacts said second zones before the first armature completely disengages from said first zones, the edges of said first zones from which the first armature disengages being tapered in a sense to cause current in the first armature to concentrate in the first armature as close to the second armature as possible.

2. A launcher according to claim 1, wherein the first armature is releasably restrainable in said start position.

3. A launcher according to claim 1 wherein said overlap of said zones has an extent in said longitudinal direction such that the second armature completely contacts said second zones before the first armature completely disengages from said first zones.

4. A launcher according to claim 1, wherein the rails comprise insulated guides adjacent said zones to guide the armatures when the armatures are not in contact with said zones.

5. A launcher according to claim 1, wherein energy absorbing means are located between the rails to stop the first armature following disengagement of the first armature from said first zones.

6. A launcher according to claim 1, wherein said zones of each rail are formed by a single conductor.

7. A launcher according to claim 1, wherein each said first zone is divided into two parts, one on each side of the second armature, said first armature having two parts, one for each part of said first zone, the two parts of said first armature being used to propel the second armature, and each said first armature part being initially in electrical contact with respective parts of said first zones.

* * * * *